US006557648B2

(12) United States Patent
Ichijyou et al.

(10) Patent No.: US 6,557,648 B2
(45) Date of Patent: May 6, 2003

(54) OPERATION MODE SWITCHING MECHANISM FOR A HAMMER DRILL

(75) Inventors: Toshihiro Ichijyou, Hitachinaka (JP); Shinichirou Satou, Hitachinaka (JP); Akira Teranishi, Hitachinaka (JP); Yukio Terunuma, Hitachinaka (JP)

(73) Assignee: Hitachi Koki Co., Ltd. (JP)

( * ) Notice: Subject to any disclaimer, the term of this patent is extended or adjusted under 35 U.S.C. 154(b) by 38 days.

(21) Appl. No.: 09/978,077

(22) Filed: Oct. 17, 2001

(65) Prior Publication Data

US 2002/0046847 A1 Apr. 25, 2002

(30) Foreign Application Priority Data

Oct. 20, 2000 (JP) ..... 2000-320386
Sep. 19, 2001 (JP) ..... 2001-284479

(51) Int. Cl.[7] ..... B25D 16/00
(52) U.S. Cl. ..... 173/48; 173/201
(58) Field of Search ..... 173/200, 201, 173/48, 109

(56) References Cited

U.S. PATENT DOCUMENTS 5,320,177 A * 6/1994 Shibata et al. ..... 173/201
5,842,527 A * 12/1998 Arakawa et al. ..... 173/48
5,873,418 A * 2/1999 Arakawa et al. ..... 173/201
6,015,017 A * 1/2000 Lauterwald ..... 173/109
6,035,945 A * 3/2000 Ichijyou et al. ..... 173/48
6,176,321 B1 * 1/2001 Arakawa et al. ..... 173/48
6,192,996 B1 * 2/2001 Sakaguchi et al. ..... 173/201

FOREIGN PATENT DOCUMENTS

| | | |
|---|---|---|
| DE | 32 35 400 | 3/1984 |
| GB | 2 121 717 | 1/1984 |
| JP | 6-57567 | 8/1994 |

* cited by examiner

*Primary Examiner*—Scott A. Smith
(74) *Attorney, Agent, or Firm*—Parkhurst & Wendel, L.L.P.

(57) ABSTRACT

A first switching member, having a claw portion engageable with a claw portion of a first gear, is slidably mounted on a crank shaft without causing any relative rotation therebetween. A first urging member resiliently urges the first switching member so that the claw portion of the first switching member is engaged with the claw portion of the first gear. A second switching member, having a claw portion engageable with a claw portion of a second gear, is slidably mounted on an intermediate shaft without causing any relative rotation therebetween. A second urging member resiliently urges the second switching member so that the claw portion of the second switching member is engaged with the claw portion of the second gear.

8 Claims, 4 Drawing Sheets

OPERATION MODE SWITCHING MECHANISM FOR A HAMMER DRILL

BACKGROUND OF THE INVENTION

The present invention relates to an operation mode switching mechanism for a hammer drill equipped with a striking force transmitting mechanism and a rotational force transmitting mechanism.

According to a conventional operation mode switching mechanism of a hammer drill, the striking force transmitting mechanism is provided around a crank shaft while the rotational force transmitting mechanism is provided around a tool shaft.

This arrangement is disadvantageous in that the longitudinal tool length becomes long and a peripheral or surrounding portion of the tool shaft cannot be downsized due to provision of the rotational force transmitting mechanism.

SUMMARY OF THE INVENTION

An object of the present invention is to provide a hammer drill having a short axial length as well as capable of realizing excellent operability with at least three operation modes.

In order to accomplish this and other related objects, the present invention provides a hammer drill comprising a motor rotating a drive shaft, an external frame member accommodating the motor therein, a first gear having a claw portion and engaged with the drive shaft for transmitting the rotation of the drive shaft, and a second gear having a claw portion and engaged with the drive shaft for transmitting the rotation of the drive shaft. The first and second gears are positioned in parallel with each other. A first switching member has a claw portion engageable with the claw portion of the first gear for transmitting the rotation of the drive shaft when the claw portion of first switching member is engaged with the claw portion of the first gear. A crank shaft is driven in response to the rotation of the first switching member. A striking force transmitting mechanism, responsive to the rotation of the crank shaft, transmits a reciprocative striking force to a tool bit. A second switching member having a claw portion engageable with the claw portion of the second gear for transmitting the rotation of the drive shaft when the claw portion of second switching member is engaged with the claw portion of the second gear. An intermediate shaft is driven in response to the rotation of the second switching member. A rotational force transmitting mechanism, responsive to the rotation of the intermediate shaft, transmits a rotational force to the tool bit. And, a switching lever selectively engages or disengages the claw portion of first switching member with or from the claw portion of the first gear and also selectively engages or disengages the claw portion of second switching member with or from the claw portion of the second gear.

According to a preferable embodiment of this invention, the first gear is rotatably mounted on the crank shaft, the first switching member is mounted on the crank shaft so as to be slidable in an axial direction of the crank shaft without causing any relative rotation therebetween, the second gear is rotatably mounted on the intermediate shaft, and the second switching member is mounted on the intermediate shaft so as to be slidable in an axial direction of the intermediate shaft without causing any relative rotation therebetween.

According to the preferable embodiment of this invention, a first urging member resiliently urges the first switching member so that the claw portion of the first switching member is engaged with the claw portion of the first gear, and a second urging member resiliently urges the second switching member so that the claw portion of the second switching member is engaged with the claw portion of the second gear.

According to the preferable embodiment of this invention, the switching lever is rotatably supported on the external frame member so that the first switching member can shift in the axial direction of the crank shaft and the second switching member can shift in the axial direction of the intermediate shaft.

According to the preferable embodiment of this invention, the second switching member has a toothed portion that is engageable with a toothed portion of a rotation restricting member, and the rotation restricting member is provided inside the external frame member so as not to cause any relative rotation therebetween.

According to the preferable embodiment of this invention, the claw portion of the second switching member is engaged with the claw portion of the second gear when the second switching member is positioned at a first position. The claw portion of the second switching member is disengaged from the claw portion of the second gear when the second switching member is positioned at a second position. And, the claw portion of the second switching member is selectively engaged with or disengaged from the toothed portion of the rotation restricting member when the second switching member is positioned at the second position.

According to the preferable embodiment of this invention, a switching assist shaft is provided so as to extend in parallel with the crank shaft and the intermediate shaft, and a shift member is provided on the switching assist shaft so as to be slidable in the axial direction without causing any relative rotation therebetween, the shift member being engageable with the first switching member or the second switching member so as to shift the first switching member in the axial direction of the crank shaft or shift the second switching member in the axial direction of the intermediate shaft.

According to the preferable embodiment of this invention, the switching lever has a first eccentric pin engageable with the first or second switching member to shift the first or second switching member in the axial direction in response to the rotation of the switch lever, and a second eccentric pin engageable with the shift member to shift the shift member in the axial direction in response to the rotation of the switch lever.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF A PREFERRED EMBODIMENT

Hereinafter, an operation mode switching mechanism for a hammer drill in accordance with a preferable embodiment of the present invention will be explained with reference to FIGS. 1 to 7.

Figure 1:
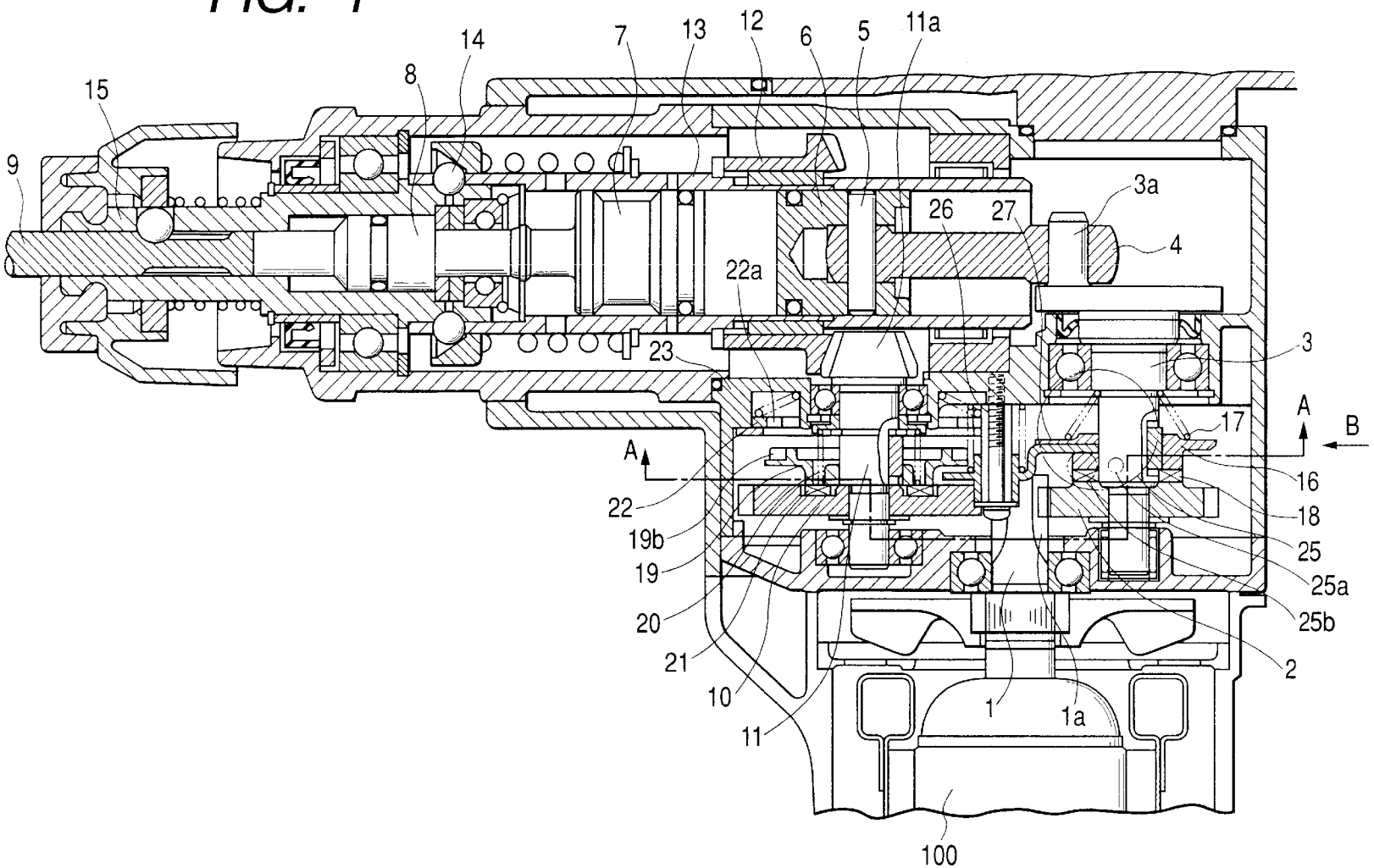
FIG. 1 is a cross-sectional diagram showing an essential arrangement of a hammer drill in a "rotation and striking mode" in accordance with a preferred embodiment of the present invention.

According to the hammer drill shown in FIG. 1, a drive shaft 1 is driven by a motor 100 accommodated in an external frame member 23. The rotation of drive shaft 1 is transmitted to a crank shaft 3 via a first gear 2. The crank shaft 3 is equipped with an eccentric pin 3*a*. A connecting rod 4 is rotatably or swingably supported around the eccentric pin 3*a*. The connecting rod 4 is connected to a piston 6 via a piston pin 5. Through this linkage, the piston 6 reciprocates in response to the rotation of the drive shaft 1. The reciprocative movement of the piston 6 functionally realizes an air spring which serves as a driving source for a striking member 7. The striking member 7 gives a striking force to a tool bit 9 via an intermediate member 8. This operation mode is generally referred to as a driving operation of the hammer drill. The members cooperatively realizing the driving operation of the hammer drill are referred to as a striking force transmitting mechanism.

Meanwhile, the rotation of drive shaft 1 is transmitted to an intermediate shaft 11 via a second gear 10. The intermediate shaft 11 is equipped with a toothed portion 11*a*. The toothed portion 11*a* of intermediate shaft 11 meshes with a third gear 12. The third gear 12 is integrally coupled with a cylinder 13. Through this linkage, the cylinder 13 rotates in response to the rotation of drive shaft 1. The cylinder 13 is integrally engaged with a tool holding member 15 via steel balls 14. The tool bit 9 is firmly held by the tool holding member 15. Thus, the tool bit 9 rotates in response to the rotation of drive shaft 1. This operation mode is generally referred to as a rotating operation of the hammer drill. The members cooperatively realizing the rotating operation of the hammer drill are referred to as a rotational force transmitting mechanism.

Figure 5:
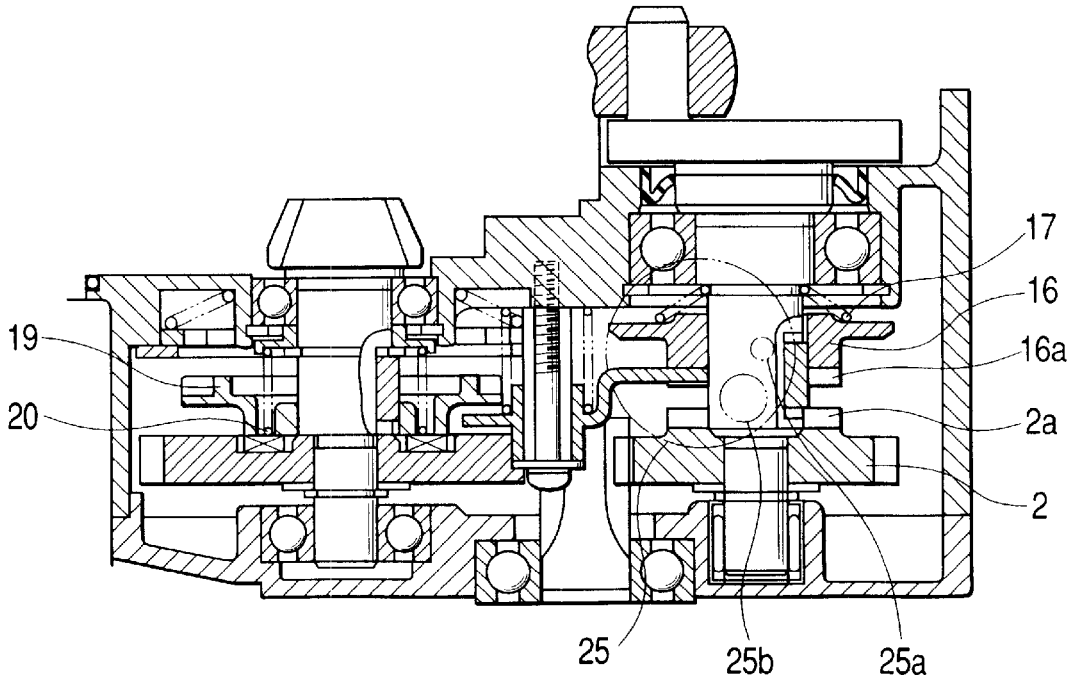
FIG. 5 is a cross-sectional diagram showing an essential portion of the hammer drill in a "rotation only mode" in accordance with the preferred embodiment of the present invention.

As shown in FIG. 5, the first gear 2 has a claw portion 2*a* at its upper surface. The claw portion 2*a* of first gear 2 is selectively engageable with a claw portion 16*a* of a first switching member 16. The first gear 2 is rotatably mounted on the crank shaft 3. The first switching member 16 is slidably mounted on the crank shaft 3, although no relative rotation is allowed between first switching member 16 and crank shaft 3. In other words, the first switching member 16 is only slidable in the axial direction of the crank shaft 3. When the claw portion 2*a* of first gear 2 engages with the claw portion 16*a* of first switching member 16, the rotation of first gear 2 is transmitted to the crank shaft 3 via the first switching member 16. A first spring 17 resiliently urges the first switching member 16 toward the first gear 2 so that the claw portion 16*a* of first switching member 16 engages with the claw portion 2*a* of first gear 2. When the first switching member 16 is forcibly shifted in the axial direction of the crank shaft 3 against the resilient force of first spring 17, the claw portion 16*a* of first switching member 16 disengages from the claw portion 2*a* of first gear 2. No rotation is transmitted from the drive shaft 1 to the crank shaft 3. In other words, the claw portion 2*a* of first gear 2 and the claw portion 16*a* of first switching member 16 cooperatively constitute a first clutch mechanism.

Figure 2:
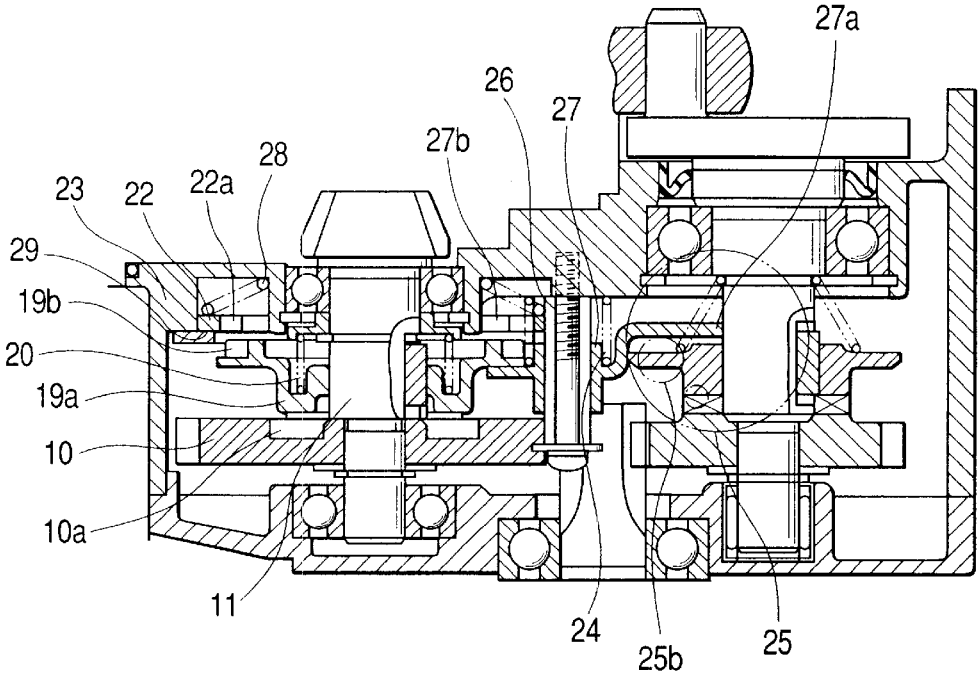
FIG. 2 is a cross-sectional diagram showing an essential portion of the hammer drill in a "neutral mode" in accordance with the preferred embodiment of the present invention.

As shown in FIG. 2, the second gear 10 has a claw portion 10*a* at its upper surface. The claw portion 10*a* of second gear 10 is selectively engageable with a claw portion 19*a* of a second switching member 19. The second gear 10 is rotatably mounted on the intermediate shaft 11. The second switching member 19 is slidably mounted on the intermediate shaft 11, although no relative rotation is allowed between second switching member 19 and intermediate shaft 11. In other words, the second switching member 19 is only slidable in the axial direction of the intermediate shaft 11. When the claw portion 10*a* of second gear 10 engages with the claw portion 19*a* of second switching member 19, the rotation of second gear 10 is transmitted to the intermediate shaft 11 via the second switching member 19. A second spring 20 resiliently urges the second switching member 19 toward the second gear 10 so that the claw portion 19*a* of second switching member 19 engages with the claw portion 10*a* of second gear 10. When the second switching member 19 is forcibly shifted in the axial direction of the intermediate shaft 11 against the resilient force of second spring 20, the claw portion 19*a* of second switching member 19 disengages from the claw portion 10*a* of second gear 10. No rotation is transmitted from the drive shaft 1 to the intermediate shaft 11. In other words, the claw portion 10*a* of second gear 10 and the claw portion 19*a* of second switching member 19 cooperatively constitute a second clutch mechanism.

Furthermore, as shown in FIG. 2, a toothed portion 19*b* is provided on an outer cylindrical portion of the second switching mechanism 19. The toothed portion 19*b* of second switching mechanism 19 is selectively engageable with a toothed portion 22*a* of a rotation restricting member 22. The rotation restricting member 22 is provided inside the external frame member 23 so as to be slidable in the axial direction of the intermediate shaft 11. No rotation is allowed between the rotation restricting member 22 and the external frame member 23. When the toothed portion 19*b* of second switching mechanism 19 is engaged with the toothed portion 22*a* of rotation restricting member 22, the rotation of intermediate shaft 11 is restricted and therefore the rotation of tool holding member 15 and tool bit 9 is stopped.

A third spring 28 resiliently urges the rotation restricting member 22 toward the second switching mechanism 19 and is brought into contact with a holding member 29 fixed on the external frame member 23 by means of screws 30. The toothed portion 22*a* of rotation restricting member 22 is engageable with the toothed portion 19*b* of second switching mechanism 19 when the second switching mechanism 19 is located at an axially upward position. In other words, the toothed portion 19*b* of second switching mechanism 19 and the toothed portion 22*a* of rotation restricting member 22 cooperatively constitute a third clutch mechanism.

A switching lever 25, having a first eccentric pin 25*a* and a second eccentric pin 25*b*, is rotatably supported on the external frame member 23 in the vicinity of the crank shaft 3. A switching assist shaft 26, provided between the first gear 2 and the second gear 10, extends in parallel with the intermediate shaft 11 and the crank shaft 3. A shift member 27 is provided on the switching assist shaft 26 so as to be slidable in the axial direction without cause any relative rotation between them.

Figure 7:
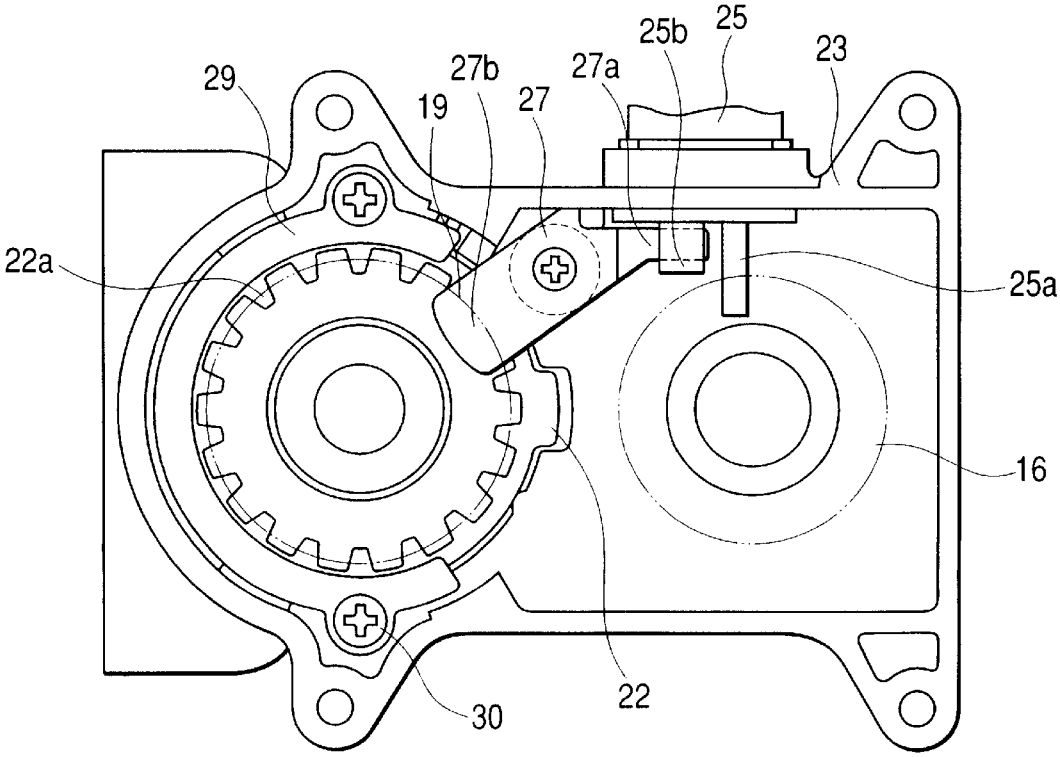
FIG. 7 is a cross-sectional diagram showing the hammer drill in accordance with the preferred embodiment of the present invention, taken along a line A—A of FIG. 1.

As shown in FIG. 7, the shift member 27 has a first shoulder portion 27*a* located at a predetermined position not causing interference with the first switching member 16 and a second shoulder portion 27*b* located beneath the second switching member 19. A fourth spring 24 resiliently urges the shift member 27 toward the drive shaft 1. When the shift member 27 is located at the lowermost axial end of the switching assist shaft 26 due to the resilient force of the fourth spring 24, the second shoulder portion 27*b* is positioned under the second switching member 19 and not brought into contact with the second switching member 19. When the shift member 27 is forcibly shifted to the uppermost axial end of the switching assist shaft 26 against the resilient force of the fourth spring 24, the second shoulder portion 27*b* is brought into contact with the second switching member 19. Then, the second switching member 19 shifts upward together with the shift member 27.

The first shoulder portion 27*a* of shift member 27 is brought into contact at its lower surface with the second eccentric pin 25*b* of switching lever 25. When the switching lever 25 rotates, the second eccentric pin 25*b* shifts the shift member 27 upward in the axial direction of the switching assist shaft 26 against the resilient force of the fourth spring 24.

Figure 6:
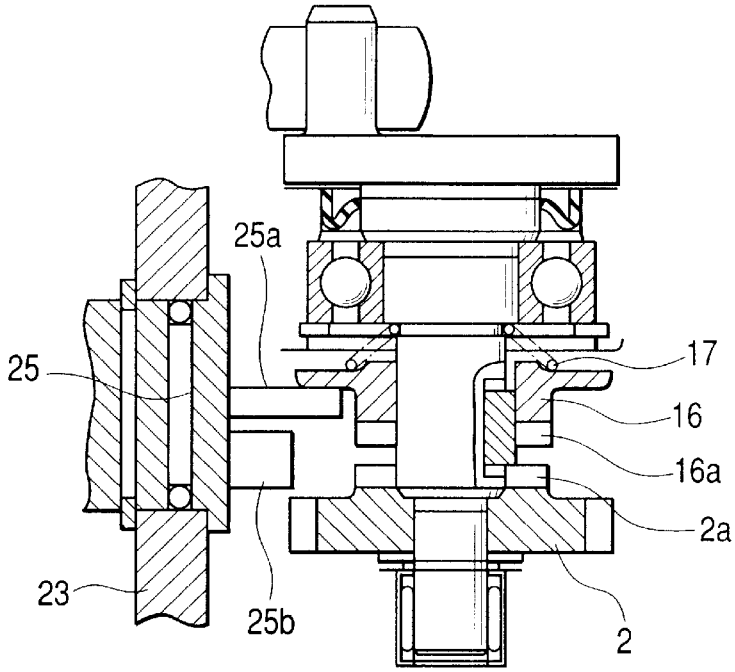
FIG. 6 is a cross-sectional diagram enlargedly showing the hammer drill in accordance with the preferred embodiment of the present invention, seen from an arrow direction B of FIG. 1.

As shown in FIG. 6, the first eccentric pin 25*a* of switching lever 25 is brought into contact with the first switching member 16. When the switching lever 25 rotates, the first eccentric pin 25*a* shifts the first switching member 16 upward in the axial direction of the crank shaft 3 against the resilient force of the first spring 17.

The above-described hammer drill operates in each mode in the following manner.

Rotation and Striking Mode

FIG. 1 shows the condition where both of the first clutch mechanism and the second clutch mechanism are engaged while the third clutch mechanism is disengaged. More specifically, the claw portion 2*a* of first gear 2 is engaged with the claw portion 16*a* of first switching member 16. The claw portion 10*a* of second gear 10 is engaged with the claw portion 19*a* of second switching member 19. And, the toothed portion 19*b* of second switching mechanism 19 is disengaged from the toothed portion 22*a* of rotation restricting member 22.

In this condition, the rotation of drive shaft 1 is transmitted to the crank shaft 3 via the first gear 2 and the first switching member 16. The rotation of crank shaft 3 actuates the striking force transmitting mechanism to cause the tool bit 9 to reciprocate in the axial direction. According to this embodiment, as described above, the striking force transmitting mechanism is constituted by the connecting rod 4 rotatably or swingably supported around the eccentric pin 3*a* of crank shaft 3, the piston pin 5, the piston 6, and the air spring provided between piston pin 5 and piston 6, and the intermediate member 8. However, the arrangement of the striking force transmitting mechanism can be modified in various ways as far as it operates in the same manner.

Furthermore, the rotation of drive shaft 1 is transmitted to the intermediate shaft 11 via the second gear 10 and the second switching member 19. The rotation of intermediate shaft 11 actuates the rotational force transmitting mechanism to cause the tool bit 9 to rotate in the circumferential direction. According to this embodiment, as described above, the rotational force transmitting mechanism is constituted by the third gear 12 meshing with the intermediate shaft 11, the cylinder 13 rotating in response to the rotation of intermediate shaft 11, the steel balls 14, and the tool holding member 15. However, the arrangement of the rotational force transmitting mechanism can be modified in various ways as far as it operates in the same manner.

In this manner, the "rotation and striking mode" is realized.

Neutral Mode

Figure 3:
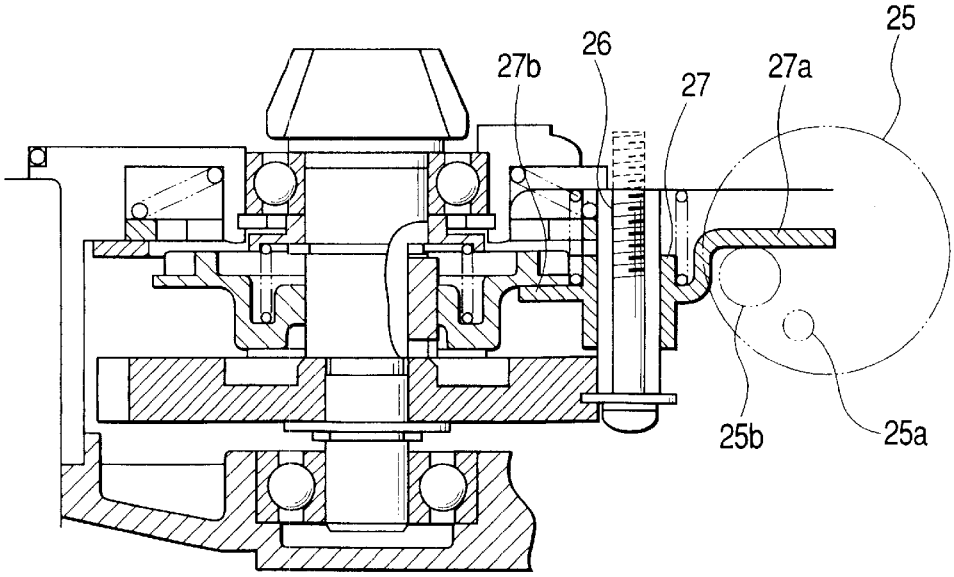
FIG. 3 is a cross-sectional diagram enlargedly showing the essential portion of the hammer drill in the "neutral mode" in accordance with the preferred embodiment of the present invention.

From the condition shown in FIG. 1, an operator rotates the switching lever 25 provided on the external frame member 23. In response to the rotation of external frame member 23, the second eccentric pin 25*b* engages with the first shoulder portion 27*a* and shifts the shift member 27 in the axially upward direction of the switching assist shaft 26. As shown in FIGS. 2 and 3, as a result of the upper shift movement of the shift member 27, the second shoulder portion 27*b* shifts the second switching member 19 in the axially upward direction of the intermediate shaft 11 against the second spring 20, thereby bringing the second clutch mechanism into a disengaged state.

In the condition shown in FIGS. 2 and 3, the third clutch mechanism is in the disengaged state. Namely, the toothed portion 19*b* of second switching mechanism 19 is disengaged from the toothed portion 22*a* of rotation restricting member 22. This condition is referred to as "neutral mode" which keeps the tool bit 9 in a free or idle running condition and allows the operator to touch and rotate the edge of tool bit 9 in an arbitrary direction.

Striking Only Mode

Figure 4:
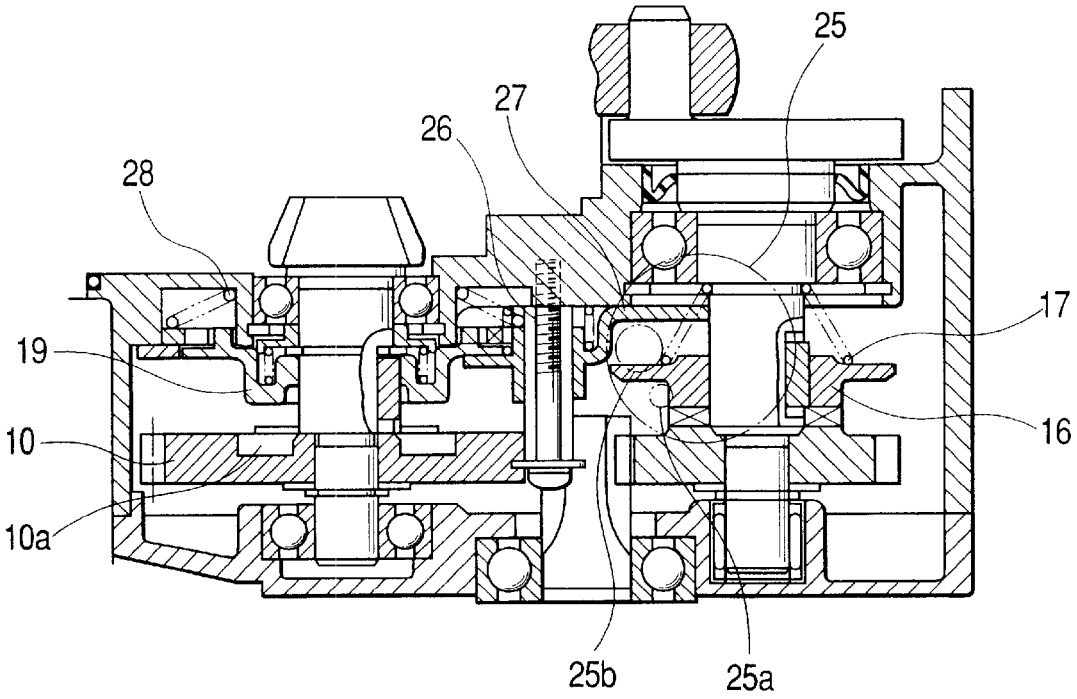
FIG. 4 is a cross-sectional diagram showing an essential portion of the hammer drill in a "striking only mode" in accordance with the preferred embodiment of the present invention.

From the condition shown in FIGS. 2 and 3, the operator further rotates the switching lever 25 to cause second eccentric pin 25*b* to further shift the shift member 27 in the axially upward direction of the switching assist shaft 26, as shown in FIG. 4. In response to the shift movement of the shift member 27, the second switching member 19 further shifts upward in the axial direction of the intermediate shaft 11 so as to bring the third clutch mechanism into an engaged state. Thus, it becomes possible to stop the rotation of second switching member 19. The rotation of tool bit 9 is also stopped as it is linked to the second switching member 19 via the holding member 15 etc.

In the above-described condition, the first clutch mechanism is in an engaged state, while the second clutch mechanism is in a disengaged state. This condition is referred to as "striking only mode" which only allows the transmission of striking force to the tool bit 9.

Rotation Only Mode

From the condition shown in FIG. 1, the operator rotates the switching lever 25 in the opposite direction to cause first eccentric pin 25*a* to shift the first switching member 16 to an axially upward position of the crank shaft 3 against the resilient force of the first spring 17, bringing the first clutch mechanism into a disengaged condition.

In this condition, the second clutch mechanism is in an engaged state. This condition is referred to as "rotation only mode" which only allows the transmission of rotational force to the tool bit 9.

According to the above-described embodiment, the "rotation and striking mode" serves as a standard condition for the mode switching operation performed for the hammer drill. The operator can select the "neutral mode" by rotating the switching lever 25 in one direction from the standard condition, the "striking only mode" by further rotating it in the same direction, or select "rotation only mode" by rotating it in the opposite direction.

As described above, the present invention makes it possible to shorten the longitudinal tool length and downsize a peripheral or surrounding portion of the tool bit. Furthermore, the present invention allows a user to easily switch the operation mode by solely turning the switching lever 25 in a clockwise or counterclockwise direction, thereby improving the operability of a hammer drill.

According to the above-described embodiment, the shift member 27 shifts the second switching member 19 in the axial direction of the intermediate shaft 11 against the resilient force of the second spring 20. The second shoulder portion 27*b* of shift member 27 is partly brought into contact with the second switching member 19. However, it is possible to modify the second shoulder portion 27*b* into a ring shape so that all of the upper surface of the ring shoulder portion 27*b* can be brought into contact with the lower end of the second switching member 19. This will smoothen the axial shift movement of the second switching member 19.

According to the above-described embodiment, the first spring 17 resiliently urges the first switching member 16 in the downward direction and the second spring 20 resiliently urges the second switching member 19 in the downward direction in the drawings (FIGS. 2 to 6). When the switching lever 25 rotates in the predetermined direction, the first and second switching members 16 and 19 shift upward against the resilient forces of first and second springs 17 and 20, thereby interrupting the transmission of the striking force and the rotational force to the tool bit 9. However, it is also preferable that the first spring 17 resiliently urges the first switching member 16 upward and the second spring 20 resiliently urges the second switching member 19 upward. In this case, the first and second switching members 16 and 19 shift downward against the resilient forces of first and second springs 17 and 20 when the switching lever 25 rotates in the predetermined direction, so as to interrupt the transmission of the striking force and the rotational force to the tool bit 9. Furthermore, it is also preferable that the urging direction of the first spring 17 is differentiated from the urging direction of the second spring 20.

Furthermore, according to the above-described embodiment, the switching lever 25 is positioned closely to the first switching member 16 rather than the second switching member 19. When the switching lever 25 rotates in the predetermined direction, the first eccentric pin 25*a* provided on the switching lever 25 engages with the first switching member 16 and shifts the first switching member 16 in the axial direction against the resilient force of first spring 17 so as to interrupt the transmission of the striking force to the tool bit 9. The second eccentric pin 25*b* engages with the second switching member 19 via the shift member 27 shiftably mounted on the switching assist shaft 26 when the switching lever 25 rotates in the predetermined direction, thereby shifting the second switching member 19 in the axial direction against the resilient force of second spring 20 so as to interrupt the transmission of the rotational force to the tool bit 9.

However, it is also preferable that the switching lever 25 is positioned closely to the second switching member 19 rather than the first switching member 16. In this case, in response to the rotation of the switching lever 25, the first eccentric pin 25*a* engages with the second switching member 19 and shifts the second switching member 19 in the axial direction against the resilient force of second spring 20 so as to interrupt the transmission of the rotational force to the tool bit 9. The second eccentric pin 25*b* engages with the first switching member 16 via the shift member 27 shiftably mounted on the switching assist shaft 26 when the switching lever 25 rotates in the predetermined direction, thereby shifting the first switching member 16 in the axial direction against the resilient force of first spring 17 so as to interrupt the transmission of the striking force to the tool bit 9.

According to the present invention, it becomes possible to dispose the rotational force transmitting mechanism on the intermediate shaft not on the tool shaft. Thus, the overall axial length of the tool can be reduced. The present invention provides a hammer drill having excellent operability with a multi-operation mode switching mechanism.

This invention may be embodied in several forms without departing from the spirit of essential characteristics thereof. The present embodiment as described is therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A hammer drill comprising:

a motor rotating a drive shaft;

an external frame member accommodating said motor therein;

a first gear having a claw portion and engaged with said drive shaft for transmitting the rotation of said drive shaft;

a second gear having a claw portion and engaged with said drive shaft for transmitting the rotation of said drive shaft, said first and second gears being positioned in parallel with each other;

a first switching member having a claw portion engageable with said claw portion of said first gear for transmitting the rotation of said drive shaft when said claw portion of first switching member is engaged with said claw portion of said first gear;

a crank shaft driven in response to the rotation of said first switching member;

a striking force transmitting mechanism responsive to the rotation of said crank shaft for transmitting a reciprocative striking force to a tool bit;

a second switching member having a claw portion engageable with said claw portion of said second gear for transmitting the rotation of said drive shaft when said claw portion of second switching member is engaged with said claw portion of said second gear;

an intermediate shaft driven in response to the rotation of said second switching member;

a rotational force transmitting mechanism responsive to the rotation of said intermediate shaft for transmitting a rotational force to said tool bit; and a switching lever for selectively engaging or disengaging said claw portion of first switching member with or from said claw portion of said first gear and also selectively engaging or disengaging said claw portion of second switching member with or from said claw portion of said second gear.

2. The hammer drill in accordance with claim 1, wherein said first gear is rotatably mounted on said crank shaft, said first switching member is mounted on said crank shaft so as to be slidable in an axial direction of said crank shaft without causing any relative rotation therebetween, said second gear is rotatably mounted on said intermediate shaft, and said second switching member is mounted on said intermediate shaft so as to be slidable in an axial direction of said intermediate shaft without causing any relative rotation therebetween.

3. The hammer drill in accordance with claim 1, wherein a first urging member resiliently urges said first switching member so that said claw portion of said first switching member is engaged with said claw portion of said first gear, and a second urging member resiliently urges said second switching member so that said claw portion of said second switching member is engaged with said claw portion of said second gear.

4. The hammer drill in accordance with claim 1, wherein said switching lever is rotatably supported on said external frame member so that said first switching member can shift in the axial direction of said crank shaft and said second switching member can shift in the axial direction of said intermediate shaft.

5. The hammer drill in accordance with claim 1, wherein said second switching member has a toothed portion that is engageable with a toothed portion of a rotation restricting member, and said rotation restricting member is provided inside said external frame member so as not to cause any relative rotation therebetween.

6. The hammer drill in accordance with claim 5, wherein said claw portion of said second switching member is engaged with said claw portion of said second gear when said second switching member is positioned at a first position, said claw portion of said second switching member is disengaged from said claw portion of said second gear when said second switching member is positioned at a second position, and said toothed portion of said second switching member is selectively engaged with or disengaged from said toothed portion of said rotation restricting member when said second switching member is positioned at said second position.

7. The hammer drill in accordance with claim 1, wherein a switching assist shaft is provided so as to extend in parallel with said crank shaft and said intermediate shaft, and a shift member is provided on said switching assist shaft so as to be slidable in the axial direction without causing any relative rotation therebetween, said shift member being engageable with said first switching member or said second switching member so as to shift said first switching member in the axial direction of said crank shaft or shift said second switching member in the axial direction of said intermediate shaft.

8. The hammer drill in accordance with claim 7, wherein said switching lever has a first eccentric pin engageable with said first or second switching member to shift said first or second switching member in the axial direction in response to the rotation of said switch lever, and a second eccentric pin engageable with said shift member to shift said shift member in the axial direction in response to the rotation of said switch lever.

* * * * *